US006193528B1

(12) United States Patent
Rea et al.

(10) Patent No.: US 6,193,528 B1
(45) Date of Patent: Feb. 27, 2001

(54) CAM LOCK SPARK PLUG WIRE CONNECTION

(75) Inventors: Michael Wayne Rea, Salem; Terry Chapin, Cortland; Suzanne Christine Nadasky, Newton Falls, all of OH (US); Justin E Bruno, Las Cruces, NM (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/562,066

(22) Filed: May 1, 2000

(51) Int. Cl.[7] ..... H01R 13/44
(52) U.S. Cl. ..... 439/127; 439/818; 123/169 PH
(58) Field of Search ..... 439/125, 127, 439/128, 818, 847; 123/169 PH

(56) References Cited

U.S. PATENT DOCUMENTS 5,011,439 * 4/1991 Pawlicki ..... 439/847
5,630,722 * 5/1997 Mchizuki et al. ..... 439/125

* cited by examiner

*Primary Examiner*—Khiem Nguyen
*Assistant Examiner*—Hae Moon Hyeon
(74) *Attorney, Agent, or Firm*—Richard A. Jones

(57) ABSTRACT

A spark plug connector (10) includes a cap (22) that mounts a terminal (30) for relative rotation with respect to a lock body (50) and outer heat shield (12). The lock body has an oval opening (58) aligned about a snap ring (48) of the terminal. When the cap member and terminal are in one rotated position, the snap ring is allowed to expand and be either installed or disconnected from the spark plug post (20). The oval minor axis is dimensioned such that when the cap and terminal are rotated approximately 90°, the snap ring abuts the lock body (50) about the oval opening and is prevented from expanding to lock the terminal (30) to the spark plug post (20).

11 Claims, 3 Drawing Sheets

CAM LOCK SPARK PLUG WIRE CONNECTION

TECHNICAL FIELD

The field of this invention relates to a spark plug and wire connection for an internal combustion engine.

BACKGROUND OF THE DISCLOSURE

A solid electrical connection of the high voltage wiring to the spark plug installed is of utmost importance in an internal combustion engine that uses an electrical spark for cylinder ignition. An electrical connection needs to be maintained from the wiring to the spark plug terminal in an extreme ambient environment. Any device that is used to maintain the connection needs to withstand vibration, high engine temperatures, and grease, dirt and water sprayed onto the connection. The connection also should suppress radio frequency interference. Furthermore, any designed connection also needs to interface with any readily available SAE standard spark plug design, and needs to interface with other engine parts without modification to the engine parts. The spark plug connection also needs to be expeditiously and economically manufactured.

While known spark plug connection designs have met these above listed design requirements, none of them have provided connection position assurance and provide a secondary lock to reduce the possibility of inadvertent disconnection from the spark plug.

What is needed is an expeditiously manufactured spark plug wire connection that provides for a secondary lock and a connection position assurance.

SUMMARY OF THE DISCLOSURE

In accordance with one aspect of the invention, a spark plug wiring terminal is selectively connected to a post of a spark plug. The post has an annular groove in proximity to its distal end. The wire terminal has an end constructed to receive the spark plug post and has at least one lateral notch in proximity to its distal end. A snap ring is constructed to extend laterally through the notch of the terminal to engage the spark plug post annular groove and is expandable along an operating axis to allow disengagement from the spark plug post. The snap ring is preferably made from spring steel and is normally biased to the engaged position with the annular groove in the spark plug post.

A lock body is mounted about the terminal for relative rotation with respect to the terminal and snap ring. The lock body has an opening that surrounds the snap ring and has a major and minor axis. The major and minor axis are respectively dimensioned such that when the major axis is aligned with the operating axis of the snap ring, the opening allows the snap ring to expand and be disengaged from the spark plug post. When the minor axis is aligned with the operating axis of the snap ring, the lock body blocks the snap ring from expanding which prevents disengagement from the annular groove in the spark plug post. Preferably, the opening is shaped in the form of an oval.

An outer shell desirably surrounds the lock body circumferentially and is rotationally affixed to the lock body. The outer shell preferably functions as a heat shield. A lower section of the outer shell is shaped to slidably receive and be rotationally affixed to the spark plug. It is preferred that the lower section of the outer shell has a hexagonal shaped lower opening that fits a hexagonal section of the spark plug. An upper section of the outer shell has a first portion of locking mechanism. In one embodiment, a bushing is interposed between the lock body and the outer shell.

A cap is connected to the terminal and rotatably affixed to the terminal such that both the terminal and cap are rotatable with respect to both the lock body and the outer shell. The cap has a second complementary portion of the locking mechanism to normally retain the cap member and the terminal in the locked position with respect to the first portion of the locking mechanism on the outer shell. It is desirable that the first portion of a locking mechanism includes a rising cam that extends from an unlocked position toward the locked position with a recess at the end of the cam to receive a portion of the cap when the cap is in the locked position. The recess at the end of the cam has an abutment shoulder adjacent thereto that normally prevents the cap from rotating to the unlocked position out of the recess.

The cap has a handle section for manual operation and a depending flange for riding on the cam of the outer shell. The recess receives the flange to retain the cap in the locked position.

In one embodiment, the cap is made from a resilient deformable plastic material to allow the depending flange to deform and ride out of the recess and over the abutment shoulder when a rotational force over a predetermined amount is applied on the cap.

BRIEF DESCRIPTION OF THE DRAWINGS

Reference now is made to the accompanying drawings in which.

DETAILED DESCRIPTION OF THE PREFERRED EMBODIMENT

Figures 1, 2:
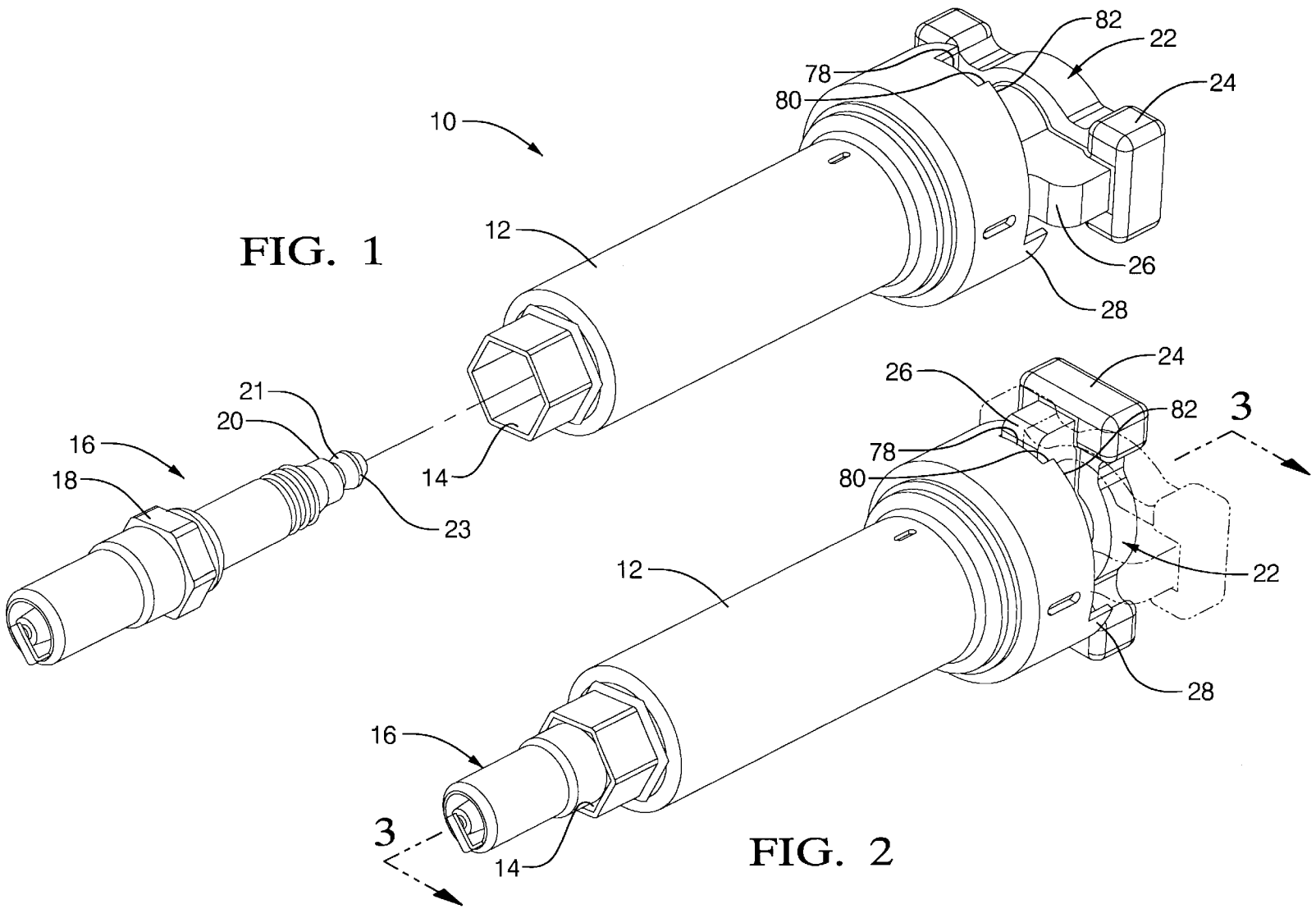
FIG. 1 is a perspective view of a spark plug connector device in accordance with the invention disconnected from a spark plug terminal.
FIG. 2 is a view similar to FIG. 1 with the spark plug connector device connected to and locked onto the spark plug terminal.

Referring now to FIGS. 1 and 2, a spark plug connector device 10 includes an outer heat shield 12 having a lower hexagonally shaped opening 14 that can receive a standard spark plug 16 about its hexagonal section 18. The spark plug post 20 with a standard groove 21 extends into the outer heat shield 12. The other end of the heat shield 12 mounts a cap 22 having a handle section 24 and depending flanges 26 that are mounted into a cam and recess end 28 of the heat shield 12. The cap 22 is rotatable between an unlocked position relative to the outer heat shield 12 as shown in FIG. 1 and a locked position shown in FIG. 2.

Figure 3:
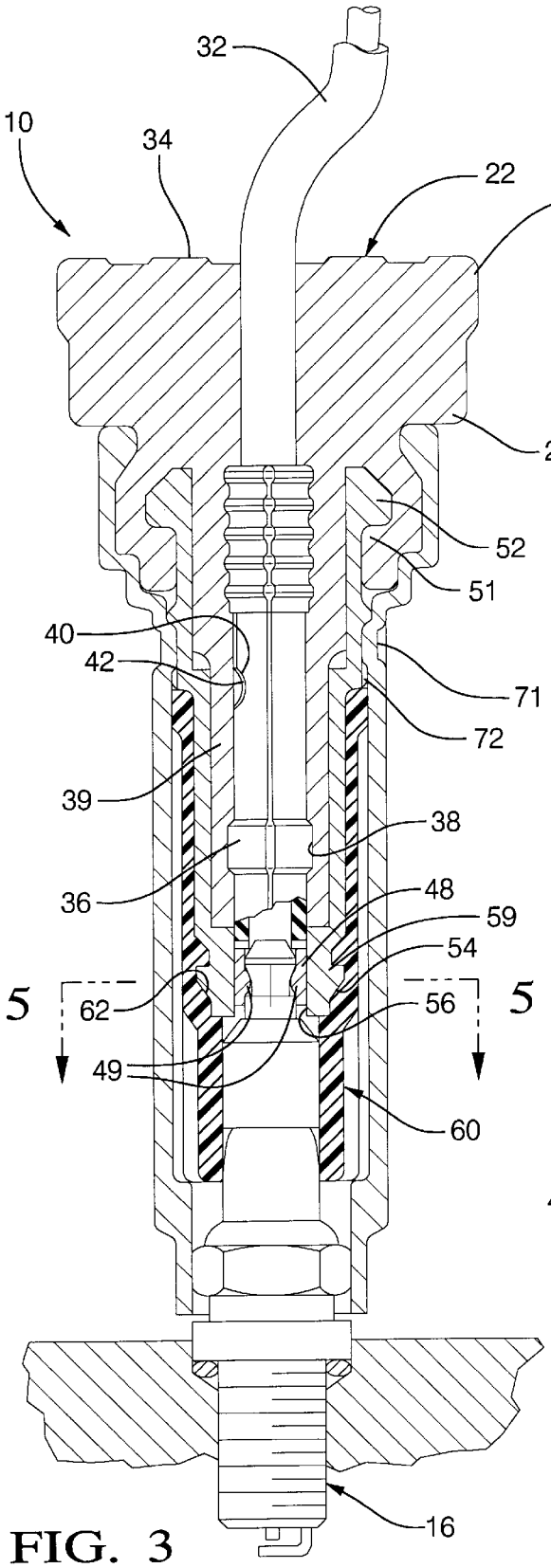
FIG. 3 is a partially segmented view of the spark plug connector device taken along lines 3—3 shown in FIG. 2.
Figure 4:
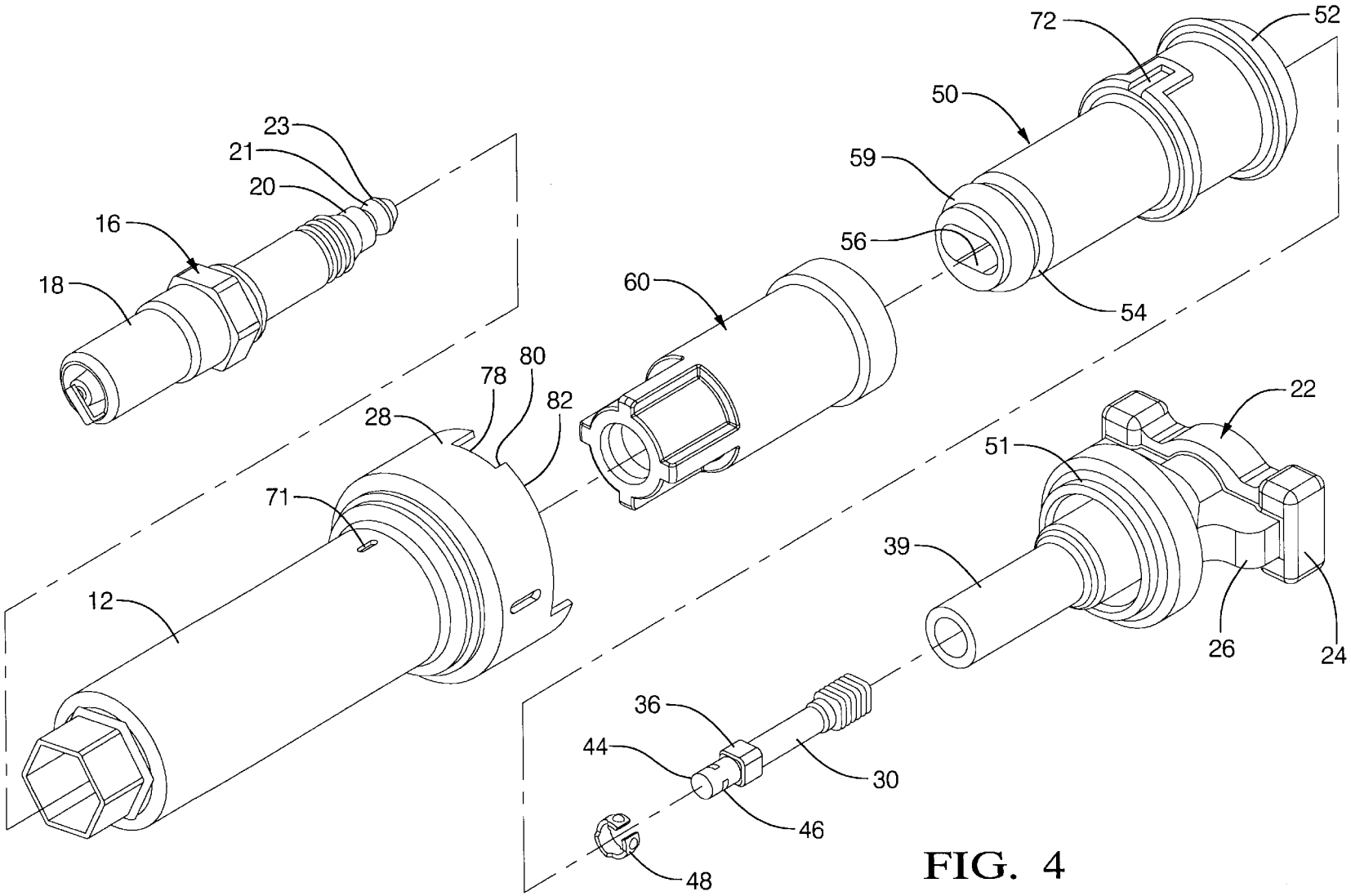
FIG. 4 is an exploded perspective view of the spark plug connector and spark plug shown in FIG. 3.

As shown more clearly shown in FIGS. 3 and 4, the cap 22 is mounted about a terminal 30. The terminal 30 is conventionally attached to electrical wiring 32 that extends out the top 34 of cap 22. The terminal 30 is mounted against axial motion in the cap by having an enlarged shoulder section 36 received in an enlarged bore section 38 in a depending leg 39 of the cap. In addition, the terminal 30 is affixed against rotation by a radially extending key 40 in the leg 39 of the cap 22 engaging a slot 42 in the terminal 30. The distal end 44 of the terminal 30 extends out of leg 39 and has a notch 46 therein that engages a snap ring 48. The snap ring is constructed to have two enlarged protuberances 49 that extend through the notch 46 and releasably engage annular groove 21 in post 20. The snap ring can be expanded against its spring bias to disengage from the groove 21 and pass over distal end 23 to completely release the terminal 30 from the post 20.

A tubular lock body 50 is mounted about the terminal and is axially affixed to the cap 22 through an annular shoulder 51 in the cap that engages an upper annular flange 52 in the lock body 50. However, the cap 22 is rotatable with respect to the lock body. The lower end 54 of the lock body 50 has a oval opening 56 with a major axis 57 and minor axis 55.

Figure 5:
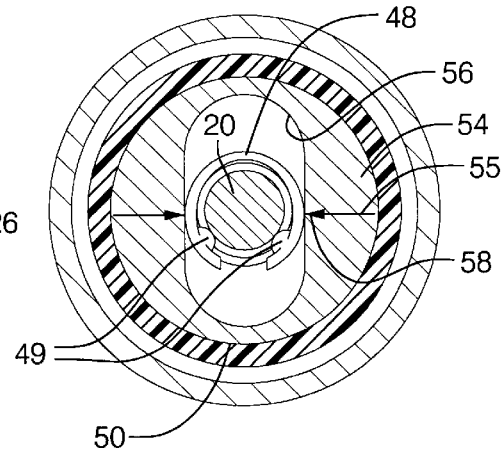
FIG. 5 is an enlarged cross-sectional view as shown along lines 5—5 shown in FIG. 3.

When the minor axis 55 is aligned with the axis 58 of expansion or operation of the snap ring 48 as shown in FIG. 5, the snap ring 48 abuts the inner wall of the lock body 50 and is prevented from expanding. Thus, when the cap 22 and terminal 30 are rotated to the position as shown in FIGS. 3 and 5 with respect to the lock body 50, the terminal is locked onto the plug post 20.

Figure 6:
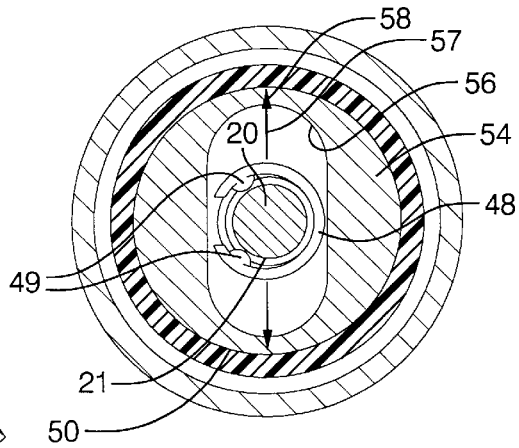
FIG. 6 is a view similar to FIG. 5 with the spark plug connector device shown rotated to the unlocked position.

Referring now to FIG. 6, when the cap 22 and terminal 30 are rotated approximately 90°, i.e. a quarter turn, the operating axis 58 of the snap ring becomes aligned with the major axis 57 of the lock body opening 56. The snap ring in this position is allowed to expand a sufficient amount to allow the snap ring to disengage from the groove 21 and allow the terminal to be pulled over distal end 23 and be completely disconnected from the plug post 20. The cap and terminal when rotated to this unlock position also allow the terminal to be installed onto the plug post over the expanded distal end 23 above the groove 21.

The lock body 50 has an annular lower flange 59 that is received in a annular groove 62 in a tubular bushing 60. The tubular bushing is slidably and rotationally fitted in the tubular outer heat shield 12. The outer heat shield 12 has an inwardly radial debossment 71 that engages an axial slot 72 in the lock body 50 to rotationally affix the lock body 50 with the outer heat shield 12.

The cam and recess end 28 and depending flange 26 in the cap 22 provide two complementary portions of a secondary locking mechanism that normally prevents free rotation of the cap 22 and terminal 30 with respect to the lock body 50 and outer shield 12. When the cap is in the position shown in FIGS. 2 and 3, the flange 26 fits within a recess 78 and abuts a side shoulder 80 to retain the flange 26 in this position. The cap can be turned by manually rotation of the handle section 24 with sufficient force to deform the flanges 26 over the side shoulder 80 and then along rising cam 82 till it is in position shown in FIG. 1.

The position of the cap shown in FIG. 1 corresponds to the unlocked position of the snap ring shown in FIG. 6. The locked position shown in FIG. 2 corresponds to the locked position of the snap ring as shown in FIG. 5. Thus the position of the cap 22 provides for an indication as to the lock or unlocked condition of the terminal with respect to the spark plug post. In addition, the spark plug connector is provided with a secondary lock mechanism that prevents inadvertent unlocking of the terminal from the spark plug post. These functions are provided in an easily manufactured and assembled device.

Variations and modifications are possible without departing from the scope and spirit of the present invention as defined by the appended claims.

The embodiments in which an exclusive property or privilege is claimed are defined as follows:

1. A device for connecting a spark plug wire to a spark plug post that has an annular groove in proximity to a distal end of the spark plug post, said device characterized by:

an electrical terminal connectable to spark plug wiring, said terminal having an end constructed to receive said spark plug post and having at least one lateral notch in proximity to a distal end of the terminal;

a snap ring engageable with said notch of said terminal and said spark plug post and being expandable along an operating axis to allow disengagement from said spark plug post but normally biased to engage said spark plug post in said annular groove;

a lock body mounted about said terminal such that said terminal is rotatable with respect to said lock body;

said lock body having an opening that surrounds said snap ring, the opening having a major axis and minor axis dimensioned such that when said major axis is aligned with said operating axis of said snap ring, said opening allows said snap ring to expand and be disengaged from said spark plug post; and when said minor axis is aligned with said operating axis of said snap ring, said lock body blocks said snap ring from expanding and disengaging from said spark plug post.

2. A device as define in claim 1 further characterized by:

said opening in said lock body being shaped in the form of an oval.

3. A device as defined in claim 2 further characterized by:

an outer shell circumferentially surrounding said lock body and rotationally affixed to said lock body;

a lower section of said outer shell shaped to slidably receive and be rotationally affixed to a spark plug body that is operably connected to said spark plug post;

an upper section of said outer shell having a first portion of locking mechanism;

a cap connected to said terminal and rotatably affixed to said terminal such that both cap and said terminal are rotatable with respect to said lock body and said outer shell;

said cap having a second complementary portion of said locking mechanism to normally retain said cap member and said terminal in said lock position with respect to said first portion of said locking mechanism on said lock body and said outer shell.

4. A device as defined in claim 3 further characterized by:

said first portion of a locking mechanism comprising said cam that extends from an unlock position toward the locked position;

a recess at the end of the cam to receive a portion of said cap when said cap is in said locked position with the recess and end of the cam forming a abutment shoulder that normally prevents the cap from rotating to the unlocked position.

5. A device as defined in claim 4 further characterized by:

said cap having a handle section for manually operation and a depending flange for riding on said cam of said outer shell and being receivable in said recess to retain the cap in the locked position.

6. A device as defined in claim 5 further characterized by:

said cap being made from a resilient deformable plastic material to allow said depending flange to deform and ride over said cam when a rotational force over a predetermined amount is applied on said cap.

7. A device as defined in claim 1 further characterized by:

an outer shell circumferentially surrounding said lock body and rotationally affixed to said lock body;

a lower section of said outer shell shaped to slidably receive and be rotationally affixed to a spark plug body that is operably connected to said spark plug post;

an upper section of said outer shell having a first portion of locking mechanism;

a cap connected to said terminal and rotatably affixed to said terminal such that both are rotatable with respect to said lock body and said outer shell;

said cap having a second complementary portion of said locking mechanism to normally retain said cap member and said terminal in said lock position with respect to said first portion of said locking mechanism on said lock body and said outer shell.

8. A device as defined in claim 7 further characterized by:

said first portion of said locking mechanism comprising a cam that extends from an unlock position toward the locked position;

a recess at the end of the cam to receive a portion of said cap when said cap is in said locked position with the recess and end of the cam forming a abutment shoulder that normally prevents the cap from rotating to the unlocked position.

9. A device as defined in claim 8 further characterized by:

said cap having a handle section for manually operation and a depending flange for riding on said cam of said outer shell and being receivable in said recess to retain the cap in the locked position.

10. A device as defined in claim 9 further characterized by:

said cap being made from a resilient deformable plastic material to allow said depending flange to deform and ride over said abutment shoulder and out of said recess when a rotational force over a predetermined amount is applied on said cap.

11. A device for connecting spark plug wiring to a spark plug post that has a groove in proximity to its distal end, said device characterized by:

a wire terminal connected to a said spark plug wiring, said terminal having an end constructed to receive said spark plug post and having at least one lateral notch in proximity to a distal end of the terminal;

a snap ring sized to fit laterally in said notch of said terminal and be expandable along an operating axis to allow disengagement from said spark plug terminal but normally biased to engage said spark plug terminal post in said groove;

a lock body mounted about said terminal such that said terminal is rotatable with respect to said lock body;

said lock body having an opening that surrounds said snap ring and having a major and minor axis dimensioned such that when said major axis is aligned with said operating axis of said snap ring, said opening allows said snap ring to expand and be disengaged from said spark plug post and when said minor axis is aligned with said operating axis of said snap ring, said lock body blocks said snap ring from expanding and disengaging from said spark plug post;

an outer heat shield shell circumferentially surrounding said lock body and rotationally affixed to said lock body with a bushing interposed there between;

a lower section of said heat shield outer shell shaped to form a hexagonal opening to slidably receive and be rotationally affixed to a conventional hexagonal shaped section of a spark plug body that is operably connected to said spark plug post;

an upper section of said heat shield outer shell having a first portion of locking mechanism;

a cap connected to said terminal and rotatably affixed to said terminal such that both are rotatable with respect to said lock body and said outer shell;

said cap having a second complementary portion of said locking mechanism to normally retain said cap member and said terminal in said lock position with respect to said first portion of said locking mechanism on said lock body and said outer shell;

said first portion of said locking mechanism comprising a rising cam that extends from an unlock position toward the locked position;

a recess at the end of the cam to receive a portion of said cap when said cap is in said locked position with the recess and end of the cam forming a abutment shoulder that normally prevents the cap from rotating to the unlocked position;

said cap having a handle section for manually operation and a depending flange for riding on said cam of said outer shell and being receivable in said recess to retain the cap in the locked position;

said cap being made from a resilient deformable plastic material to allow said depending flange to deform and ride over said cam when a rotational force over a predetermined amount is applied on said cap.

* * * * *